US007195158B2

(12) United States Patent
White

(10) Patent No.: US 7,195,158 B2
(45) Date of Patent: Mar. 27, 2007

(54) BAGGAGE IDENTIFICATION SYSTEM

(76) Inventor: Andre M. White, 5122 Hunters Luck, Decatur, GA (US) 30088

( * ) Notice: Subject to any disclaimer, the term of this patent is extended or adjusted under 35 U.S.C. 154(b) by 69 days.

(21) Appl. No.: 10/956,390

(22) Filed: Oct. 1, 2004

(65) Prior Publication Data

US 2006/0071069 A1 Apr. 6, 2006

(51) Int. Cl.
*G07B 15/02* (2006.01)

(52) U.S. Cl. ..... 235/384; 283/80; 40/6

(58) Field of Classification Search ..... 235/384; 283/81; 40/6, 634
See application file for complete search history.

(56) References Cited

U.S. PATENT DOCUMENTS 4,180,284 A * 12/1979 Ashley ..... 283/70
5,920,053 A * 7/1999 DeBrouse ..... 235/375
6,364,365 B1 * 4/2002 Caplan ..... 283/80
6,860,045 B1 * 3/2005 Sadler et al. ..... 40/1.5

* cited by examiner

*Primary Examiner*—Seung Ho Lee
(74) *Attorney, Agent, or Firm*—John L. James

(57) ABSTRACT

A baggage identification system has a label and a key fob. The label has a front face with a distinctive design thereon, and a rear face with an adhesive thereon. A backing material attached to the adhesive on the rear face of the label is removable to expose the adhesive for affixing the label to the baggage. The key fob has a design thereon matching the design on the label.

2 Claims, 1 Drawing Sheet

BAGGAGE IDENTIFICATION SYSTEM

FIELD OF THE INVENTION

The present invention pertains primarily to an apparatus and method for identifying particular baggage in a transportation baggage claim facility.

BACKGROUND OF THE INVENTION

There is a finite number of different baggage sizes and shapes manufactured making it almost impossible to identify a particular piece of baggage by its size or shape from among the many pieces of baggage in a transportation baggage claim facility. The number of exterior colors and exterior covering patterns for baggage is also limited making baggage identification by color or pattern difficult. Accordingly, it will be appreciated that it would be highly desirable to have a simple way to identify baggage at a baggage claim facility.

SUMMARY OF THE INVENTION

The present invention is directed to overcoming one or more of the problems set forth above. According to one aspect of the present invention, a baggage identification system comprises a label and a key fob. The label has a front face with an adhesive thereon. A backing material is removably attached to the adhesive on the rear face of the label. The key fob has a design thereon matching the design on the label.

According to another aspect of the invention, a method for identifying baggage at a transportation baggage claim facility comprises imprinting a distinctive pattern on a front face of a label, applying an adhesive to a rear face of the label, applying the distinctive pattern to a key fob, applying the label to a piece of baggage, and matching the fob with the label on the luggage at the baggage claim facility.

The system is simple to use requiring only that the user attach to the key fob to the keys normally carried on the user and attach the label to the baggage. To retrieve baggage from the baggage claim area, the user simply matches the pattern on the key fob with the pattern on the label on the baggage.

These and other aspect, objects, features and advantages of the present invention will become more apparent from a study of the detailed description of the invention and by reference to the accompanying drawings.

DETAILED DESCRIPTION OF THE PREFERRED EMBODIMENTS

Figure 1:
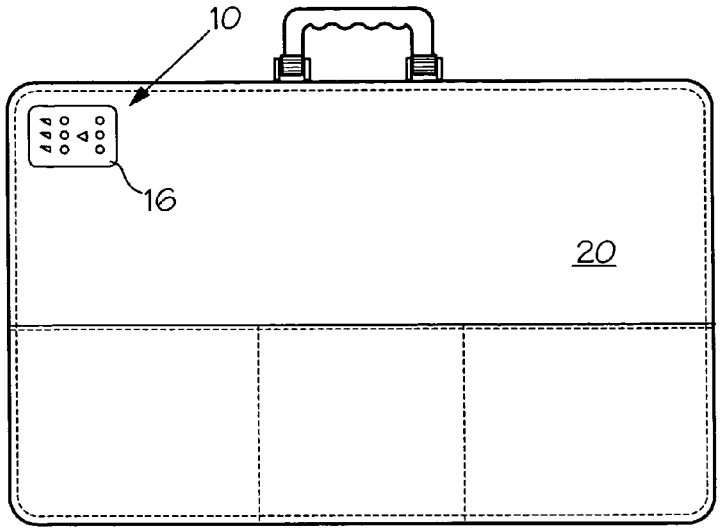
FIG. 1 is a front view of a preferred embodiment of a label imprinted with a pattern attached to a piece of baggage according to the present invention.
Figure 2:
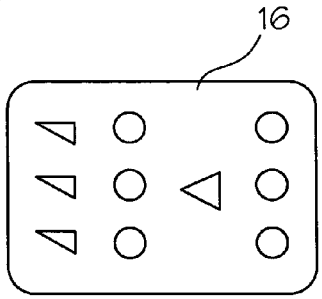
FIG. 2 is front view of the label illustrated in FIG. 1.
Figure 3:
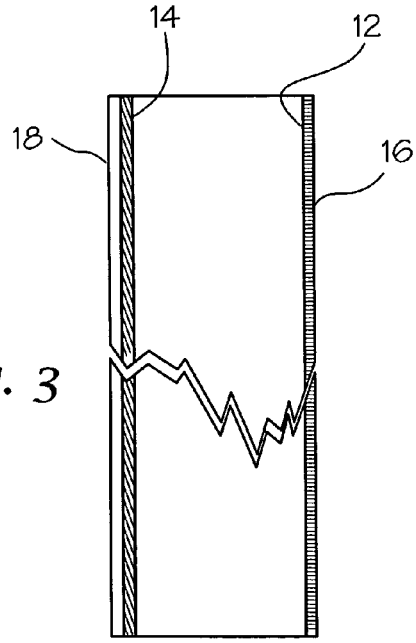
FIG. 3 is an end view of the label illustrated in FIG. 2.

Referring to FIGS. 1–4, a baggage identification system includes a label 10 having a front face 12 and a rear face 14. The front face 12 has a distinctive pattern or design 16 thereon. The pattern or design 16 may, in its simplest form, be a distinctive or unique color or may be a geometric pattern. The pattern is preferably imprinted on the front face 12 but may be integrally formed with the front face, embossed or applied by other means.

The rear face 14 of the label 10 has an adhesive 18 thereon for attaching the label to the baggage 20. A backing material 18 is removably attached to the adhesive on the rear face of the label. The backing material 18 is preferably paper that is easily removed from the adhesive.

Figure 4:
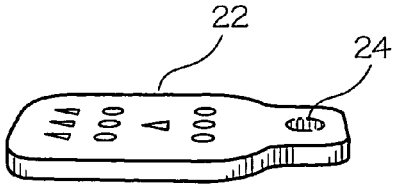
FIG. 4 is a key fob imprinted with the same pattern as the label of FIG. 2.

Referring to FIG. 4, the baggage identification system includes a key fob 22 that has a pattern or design thereon matching the design on the label. The key fob has an opening 24 for receiving a key ring.

It can now be appreciated that an apparatus and method for identifying baggage has been presented. The apparatus includes an adhesive backed label with a distinctive pattern or design on its front face, and a key fob. The label is affixed to the baggage using the adhesive backing. At the destination, the use matches the design on the key fob with the design on the label.

The method for identifying baggage at a transportation baggage claim facility includes imprinting a distinctive pattern on a front face of a label, applying an adhesive to a rear face of the label, applying the distinctive pattern to a key fob, applying the label to a piece of baggage, and matching the fob with the label on the luggage at the baggage claim facility.

While the invention has been described with particular reference to the preferred embodiments, it will be understood by those skilled in the art that various changes may be made and equivalents may be substituted for elements of the preferred embodiment without departing from invention. For example, while it is anticipated that the label will be constructed of simple paper and used for a single trip, it can be made of a more durable paper or paper like material or plastic and used for several trips. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur th those skilled in the art. For example, the label and key fob can have reflective or high visibility patterns or designs to aid in identification. It is accordingly intended that the claims shall cover all such modifications and applications as do not depart from the true spirit and scope of the invention.

What is claimed is:

1. A two-part baggage identification system, comprising:

a label having a front face, a rear face and a paper backing material, said front face having a distinctive pattern thereon, said rear face having an adhesive thereon, said paper backing material being removably attached to said adhesive on said rear face of said label; and a separate key fob having a pattern thereon matching said pattern on said label.

2. A method for identifying baggage at a transportation baggage claim facility, comprising the steps of:

imprinting a distinctive pattern on a front face of a label;

applying an adhesive to a rear face of the label;

applying a paper backing material to said rear face of the label and covering the adhesive;

applying the distinctive pattern to a separate key fob;

removing the paper backing material from said rear face of the label;

applying the label to a piece of baggage; and matching the fob with the label on the luggage at the baggage claim facility.

* * * * *